US006125935A

United States Patent [19]

Shahin, Jr.

[11] Patent Number: 6,125,935

[45] Date of Patent: Oct. 3, 2000

[54] METHOD FOR MONITORING WELL CEMENTING OPERATIONS

[75] Inventor: Gordon Thomas Shahin, Jr., Bellaire, Tex.

[73] Assignee: Shell Oil Company, Houston, Tex.

[21] Appl. No.: 09/433,985

[22] Filed: Nov. 4, 1999

Related U.S. Application Data

[63] Continuation of application No. 08/826,205, Mar. 27, 1997, abandoned.

[60] Provisional application No. 60/014,358, Mar. 28, 1996.

[51] Int. Cl.[7] ..... E21B 33/14; E21B 47/06

[52] U.S. Cl. ..... 166/250.14; 166/66; 73/152.51; 73/152.52

[58] Field of Search ..... 166/250.01, 250.07, 166/250.14, 253.1, 66; 73/152.51, 152.52, 152.57

[56] References Cited

U.S. PATENT DOCUMENTS

| | | | |
|---|---|---|---|
| 2,708,000 | 5/1955 | Zandmer | 166/100 |
| 2,786,531 | 5/1957 | Mangold et al. . | |
| 3,489,219 | 1/1970 | Higgins | 166/253.1 |
| 4,191,250 | 3/1980 | Messenger | 166/253.1 |
| 4,440,226 | 4/1984 | Suman, Jr. | 166/250.14 |
| 4,475,591 | 10/1984 | Cook, Jr. | 73/152.18 |
| 4,548,266 | 10/1985 | Burklund . | |
| 4,553,428 | 11/1985 | UPchurch | 73/152.51 |
| 4,662,442 | 5/1987 | Debreuille . | |
| 4,775,009 | 10/1988 | Wittrisch et al. . | |
| 4,924,701 | 5/1990 | Deltorre | 73/152.51 |
| 4,976,142 | 12/1990 | Perales . | |
| 5,142,471 | 8/1992 | Desbrandes | 364/422 |
| 5,163,321 | 11/1992 | Perales . | |
| 5,233,304 | 8/1993 | Hubans | 324/323 |
| 5,303,773 | 4/1994 | Czernichow et al. | 166/66 |
| 5,327,969 | 7/1994 | Sabins et al. | 166/250.14 |
| 5,348,093 | 9/1994 | Wood et al. | 166/250.14 |
| 5,355,951 | 10/1994 | Allen et al. | 166/253.1 |
| 5,377,160 | 12/1994 | Tello et al. | 166/253.18 |
| 5,467,823 | 11/1995 | Babour et al. | 166/250.01 |
| 5,473,939 | 12/1995 | Leder et al. | 73/152.51 |
| 5,860,483 | 1/1999 | Havig | 166/66 X |
| 5,947,199 | 9/1999 | Havig | 166/250.01 X |

FOREIGN PATENT DOCUMENTS 1582241 1/1981 European Pat. Off. .

OTHER PUBLICATIONS

PCT/EP 97/01621 Search Report.

R. A. Akmetov et al., "Measurements of Pressure and Temperature in Cemented Annular Space of a Well," *Burenie* (1974), No. 7, 36–39.

C. E. Cooke, Jr. et al., "Field Measurements of Annular Pressure and Temperature Duri Primary Cementing," *Journal of Petroleum Technology*, Aug. 1983, 1429–1438.

Definition of "frit" from *Hackh's Chemical Dictionary*, Fourth Edition, Julius Grant, Editor, Copyright 1969.

"Frits" advertisement, 3 pp. (undated).

Webster's Ninth New Collegiate Dictionary, Merriam–Webster, Inc., 1983.

*Primary Examiner*—George Suchfield
*Attorney, Agent, or Firm*—Mark A. Smith

[57] ABSTRACT

A method for monitoring a cementing operation is disclosed for predicting whether an effective formation-to-casing seal has been formed across an annulus of a well. In this method a distributed well monitoring system is installed in the annulus of the well before the cement is pumped. Once pumped, the cement is monitored substantially along the annulus. The pressure in the annulus is determined at cement transition and this pressure is compared to the maximum formation pressure as an indication of whether the cement had set to a strength sufficient to maintain an effective formation-to-casing seal across the annulus.

6 Claims, 7 Drawing Sheets

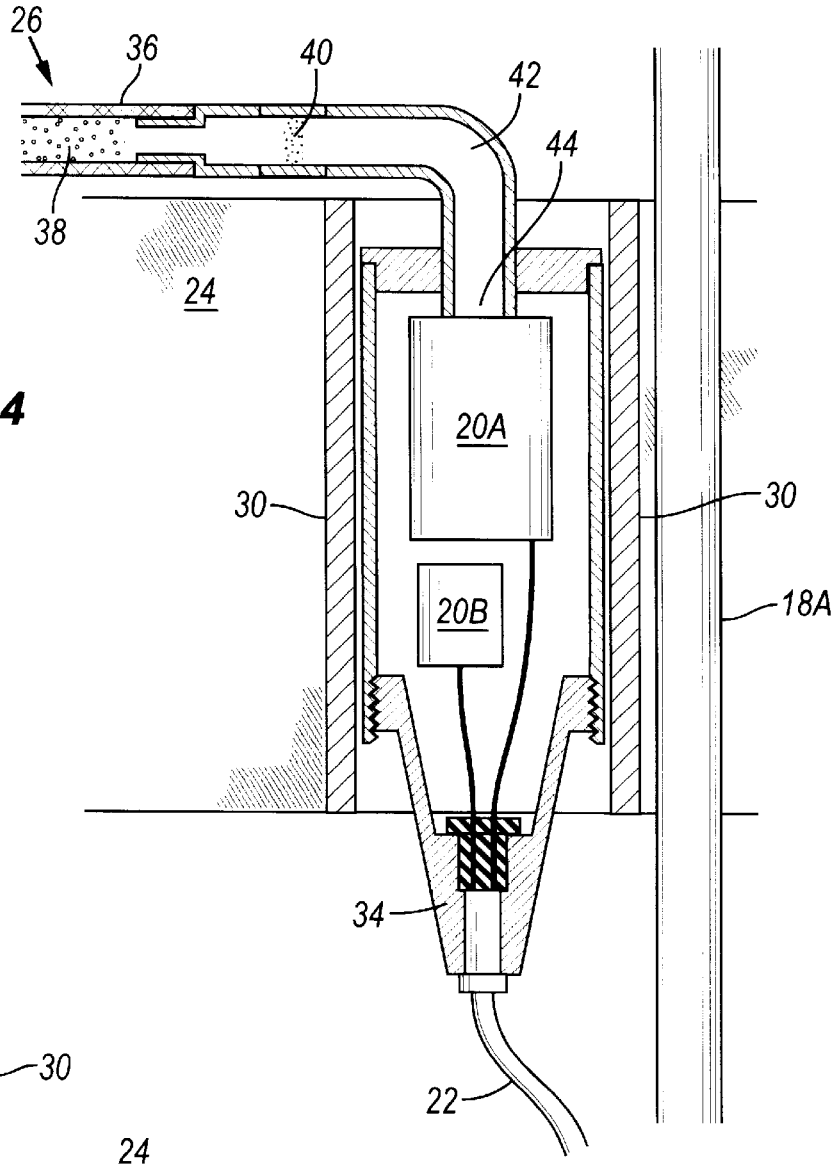
FIG. 4
FIG. 3
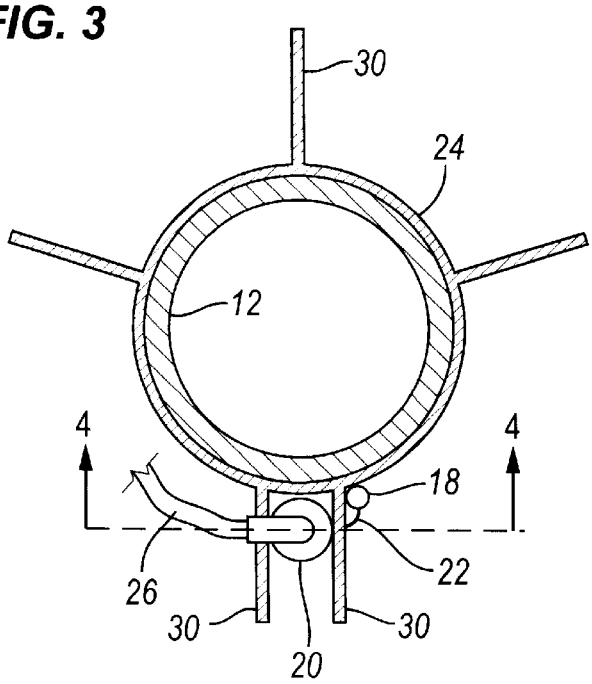

METHOD FOR MONITORING WELL CEMENTING OPERATIONS

This is a continuation of application Ser. No. 08/826,205 filed Mar. 27, 1997, now abandoned, the entire disclosure of which is hereby incorporated by reference.

Further, this application claims the benefit of U.S. Provisional Application No. 60/014,358 filed Mar. 28, 1996 the entire disclosure of which is hereby incorporated by reference

BACKGROUND OF THE INVENTION

The present invention relates to a method and system for monitoring well cementing operations. More particularly, the present invention relates to a method and system for simultaneously monitoring pressure along the annulus of a well during cementing operations to determine whether remedial cementing is likely to be required.

Current and reliable information regarding conditions at zones of a formation can aid in completing wells. In such applications a borehole is drilled to cross multiple zones of a formation. Some of the intersected zones may contain hydrocarbon bearing strata or otherwise have a geopressure that may interfere with the ability of the cement job to effectively seal the borehole wall to the casing across the annulus unless the cement is properly matched to conditions along the annulus. Timely information indicating whether the seal is effective or not will permit prompt remedial action on this well and, perhaps, suggest redesign of the cement job in time for subsequent wells in the same field that are being cemented in batch operations.

A single downhole gauge may be placed to monitor conditions, e.g., pressure, at a given interval. This will provide current and reliable information, but only for a specific location and this may prove insufficient for well management purposes. Alternatively, commercial services provide "repeat formation testing" in which a wireline tool is run and multiple readings are taken as the tool is retrieved. This does provide data on multiple zones, but the information is not truly simultaneous and is collected only intermittently. These techniques are not practical for monitoring cementing operations.

Thus, there remains a clear need for a method and system for providing early indications of the likely effectiveness of a cement job in oilfield applications.

SUMMARY OF THE INVENTION

Toward providing these and other advantages, the present invention is a method for monitoring a cementing operation to predict whether an effective formation-to-casing seal has been formed across an annulus of a well. In this method a distributed well monitoring system is installed in the annulus of the well before the cement is pumped. Once pumped, the cement is monitored substantially along the annulus. The pressure in the annulus is determined at cement transition and this pressure is compared to the maximum formation pressure as an indication of whether the cement had set to a strength sufficient to maintain an effective formation-to-casing seal across the annulus.

BRIEF DESCRIPTION OF THE DRAWINGS

The brief description above, as well as further advantages of the present invention, will be more fully appreciated by reference to the following detailed description of the preferred embodiments which should be read in conjunction with the accompanying drawings in which:

FIG. 3 is an axially cross sectioned view of the pressure sensor of FIG. 2 as taken at line 3—3 in FIG. 2;

FIG. 4 is a cross sectional view of the pressure sensor of FIG. 3 taken along line 4—4 of FIG. 3;

DETAILED DESCRIPTION OF ILLUSTRATIVE EMBODIMENTS

Figure 1:
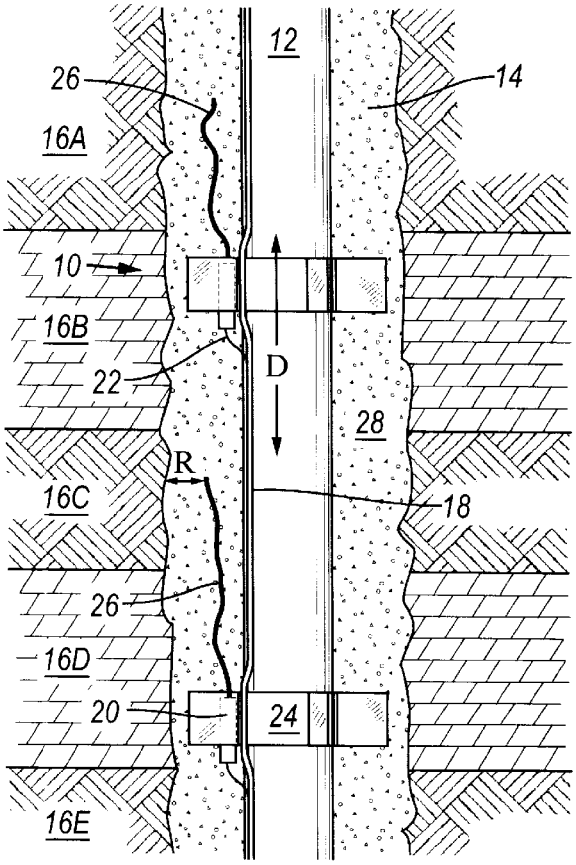
FIG. 1 is a side elevational view of a distributed pressure monitoring system in accordance with the present invention.

A distributed monitoring system 10 is illustrated in FIG. 1 mounted to the exterior of casing 12. The casing is run within borehole 14 which intersects multiple zones 16A–16E in the illustrated interval. A communications line 18 runs along the casing and branches off to sensors 20 at pigtails 22. The sensors are mounted to the casing at protectolizers 24 which protect both the sensors and the communication line during installation. Sensors, here pressure sensors 20A, are provided with open pressure tentacles 26. A cement 28 fills the annulus between the borehole wall and the casing.

Figure 2:
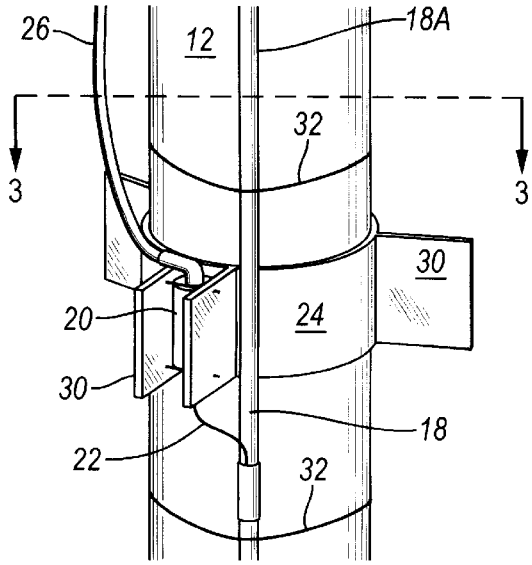
FIG. 2 is a perspective view of a single pressure sensor mounted to a casing.

Protectolizer 24 is a modified centralizer mounted on casing 12. FIG. 2 illustrates pressure sensor 20 mounted and pinned between adjacent vanes 30 of protectolizer 24. The communications line is attached to casing 12 with straps or ties 32 and is also protected from contact with the borehole wall when casing 12 is lowered into place. See also FIG. 3.

Communication may be provided through telemetry or through a communications line 18 as may vary in accordance with the sensor and transmission needs. Those having skill in the art will understand the present invention to have application across a wide variety of sensor needs. Potential applications include pressure, temperature, and fluid composition. If a communications line 18 is deployed, it may be a multiple wire or multiline cable bundling a plurality of discrete wires. Alternatively, a fiber optic bundle may be used. In some embodiments, communications line 18 may even be formed with a bundle of capillary tubes, e.g., to transmit pressure directly from a sensor input element in the form of an open end with a fluid interface which communicates with surface sensors through an inert fluid in the capillary tube. In other applications it may be desired to monitor fluid composition with an infra-red or IR sensor to determine the oil, gas, and water makeup of current formation fluids. However, for the purposes of illustration, an embodiment of the invention is disclosed for monitoring pressure and, optionally, temperature. These are two parameters which are traditionally of great interest in reservoir management.

In this embodiment, communications line 18 is formed by multiline cable 18A, with each pigtail 22 connecting one of the sensors to a discrete wire within the cable.

FIG. 4 is a schematic illustration cross sectioning sensor 20. Here, sensor 20 carries a pressure transducer 20A and a temperature sensor 20B within sensor housing 34. The pressure transducer and temperature sensor forward signals to the surface through pigtail 22 and multiline cable 18A. Pressure transducer 20A samples the formation pressure through open pressure tentacle 26 in the form of stainless steel wire mesh hose 36 which is packed with gravel 38. A frit 40 separates tentacle 26 from pressure transducer 20A and the frit allows formation pressure to pass and impinge upon silicone grease pack 42, and therethrough upon diaphragm 44 of pressure transducer 20A. However, the frit is also instrumental in separating the overburden pressure from the formation pressure.

Figure 5:
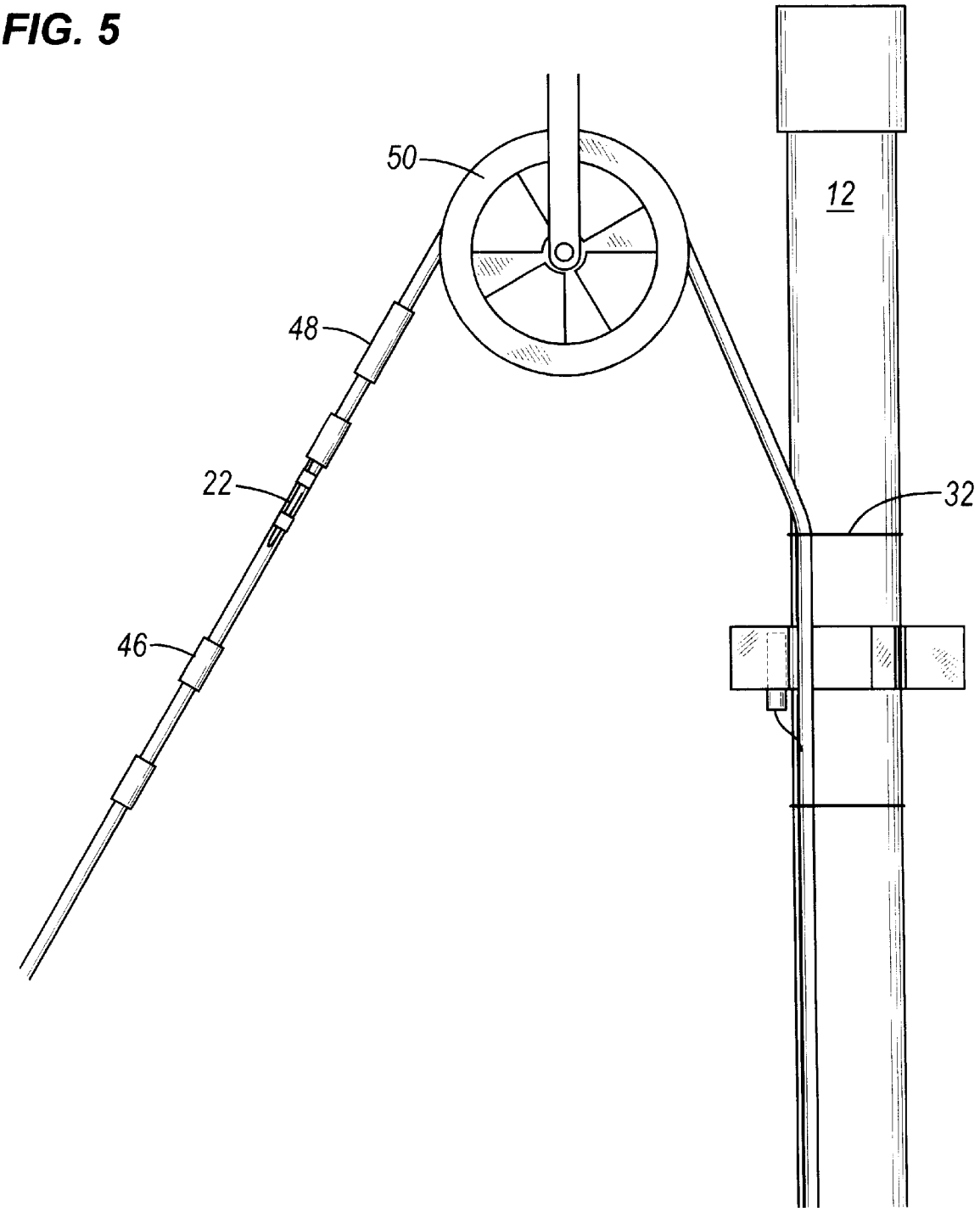
FIG. 5 is a side elevational view illustrating installation of a distributed pressure monitoring system.

FIG. 5 illustrates installation of a distributed pressure monitoring system. Multiline cable 18A arrives for installation spooled. In the illustrated embodiment, it is spooled with fluid blockers 46, pigtails 22 and repair sleeves 48 positioned to connect to sensors along the casing upon installation. The fluid blockers are lengths of pipes sealed tightly about the cable. These pipe lengths create a superior bond with the cement and prevent fluid migration between sensors 20 along communication line 18. The repair sleeves facilitate repair should the cable be damaged in handling. In that event, the breach is filled with resin and the sleeve slides into position thereover and is clamped and/or glued in place to secure the seal. The spooled cable is fed over a sheave 50 and cable 18A is tied in place about casing 12 with straps or ties 32. A sensor 20 is mounted within protectolizer 24 and is connected to cable 18A through pigtail 22 which is untaped from the spooled cable and plugged into the sensor. Another joint is made up to casing 12 and the previous casing section, with distributed pressure monitoring system 10 attached, is advanced through the slips which may be modified to best accommodate this additional equipment as the monitoring system is connected to the next length of casing, and so on.

After the casing is set, it is cemented into place. See FIG. 1. The selection of cement 28 is important in the overall design. The diffusivity of the parameter to be monitored (in this case pressure) should be less in the cement than in the formation so as not to compromise the zonal measurement of interest. However, the diffusivity should not be so small that it inhibits the measurement of interest.

Diffusivity is a parameter which characterizes the rate of transport of heat, mass or fluid-momentum. Hydraulic diffusivity, "α" characterizes the diffusion of pressure as fluid is transported rough porous media. It is defined as:

$$\alpha = \frac{\text{permeability}}{\text{porosity} \times \text{viscosity} \times \text{compressibility}}$$

where, for the cement:

permeability is the permeability of the cement;

porosity is the porosity of the cement;

viscosity is the viscosity of the fluid within the cement matrix with the cement; and compressibility is the compressibility of the system, including the cement and the fluids injected therewith.

Axial separation of sensors in adjacent zones is selected such that radial transmission from the borehole wall will greatly exceed axial transmission along the borehole between adjacent sensors. Stated differently and returning to the example of pressure measurement, the fluid and pressure transmission are a function of time, diffusivity, and distance, the relationship of which may be roughly approximated by the following equation when the radius of the well bore and the radius of the casing are of comparable size and the curvature within the cement annulus can be reasonably neglected:

$$\%\ \text{pressure transmitted} = \text{erfc}[d/\sqrt{(\alpha t)}]$$

where:

erfc( )=the complementary error function

α=diffusivity t=time d=distance of concern which pressure is transmitted through the cement Applying this basic relationship to the geometry of the borehole, a maximum distance from the formation (borehole wall) to the sensor may be expressed as follows:

$$\frac{R_{\max}^2}{\alpha t} = C_1^2$$

where:

$R_{max}$=maximum radial distance, i.e., separation, between the sensor and the formation at the borehole wall α=diffusivity of the cement t=time erfc $[C_1]$=% pressure transmitted from formation to sensor Similarly, the minimum spacing between adjacent sensors which influences pressure interference between transducers may be expressed as:

$$\frac{D_{\min}^2}{\alpha t} = C_2^2$$

where:

$D_{min}$=minimum axial distance or separation between the pressure sensing elements of adjacent sensors α=diffusivity of the cement t=time erfc $[C_2]$=% pressure transmitted across axial separation of sensors For instance, and by way of example, only at least 98% of the pressure is transmitted through the borehole to a transducer when $$\frac{R_{\max}^2}{\alpha t} < C_1^2$$

where erfc $[C_1]$=0.98 and $R_{max}$ is the maximum separation between a sensor and the formation. Similarly, the pressure interference between adjacent pressure sensors is minimized to less than 2% error when $$\frac{D_{\min}^2}{\alpha t} < C_2^2$$

where erf $[C_2]$=0.02, and $D_{min}$ is the minimum axial separation between the pressure sensing element of two transducers. The actual spacing and corresponding choice of acceptable errors are part of the design specification.

Because of the nonlinear nature of this relationship between distance and time, pressure can be seen to be far more readily transmitted over short distances such as between the formation and the nearest sensor than over the moderate distances which separate adjacent sensors. This allows substantial isolation of data from adjacent formation zones intersected by the borehole with corresponding pressure sensors.

The borehole is filled with cement having a hydraulic diffusivity designed to meet the aforementioned criteria. The pressure tentacles are arranged such that, when cemented, they will come into close proximity with the borehole wall ($R_{max}$) at least somewhere along the length of the pressure tentacle. The adjacent pressure sensors separated axially along the borehole such that the distance between pressure sensors ($D_{min}$) makes the sensors relatively insensitive to axial pressure transmission through the cement when compared to radial pressure transmission from the borehole to the pressure tentacle.

Cement in drilling and completion arts is commonly made up from the following components: Class G cement, Cement Friction Reducer, mixed metal hydroxides, sodium silicate, flyash, silica flour, silica sand, fumed silica, spherelite, and bentonite gel. With this range of variables and the state of present documentation of characteristics, selecting an appropriate cement for a given application may involve a testing program with respect to time, temperature, permeability and compressive strength.

Cement selection and sensor placement may be more clearly illustrated by working through an example designing a distributed pressure monitoring system for application in a given well.

ILLUSTRATIVE DESIGN EXAMPLE

Figure 9:
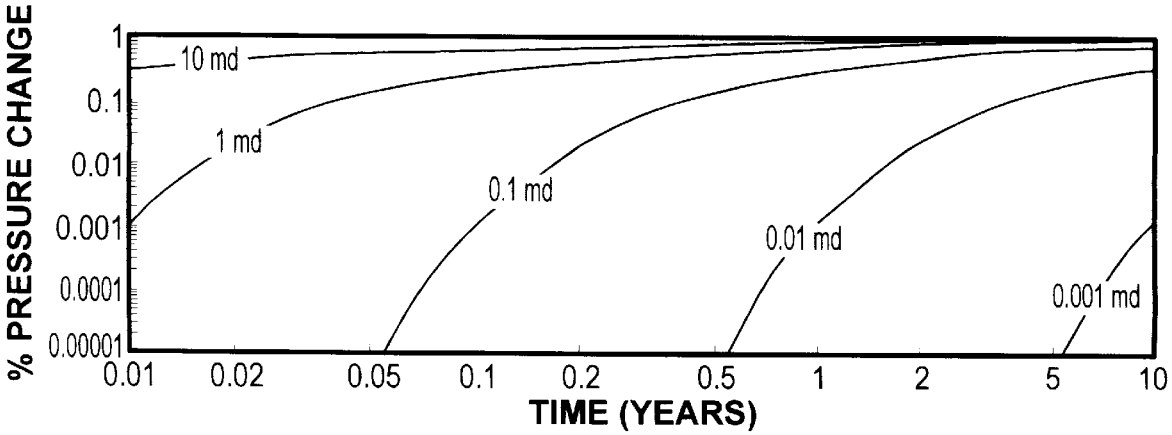
FIG. 9 is a graph illustrating pressure propagation modeled for a particular well, parametrically plotted against time and cement permeability.
Figure 10:
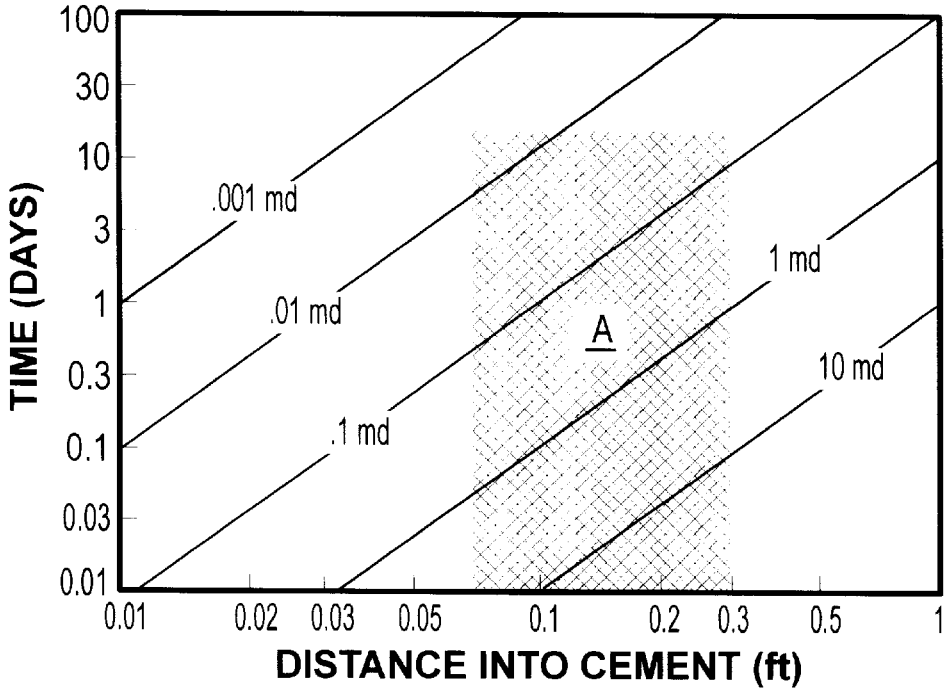
FIG. 10 is a graph illustrating results of modeling pressure response as a function of time, distance and permeability for pressure transmission from a selected zone to an adjacent sensor.
Figure 11:
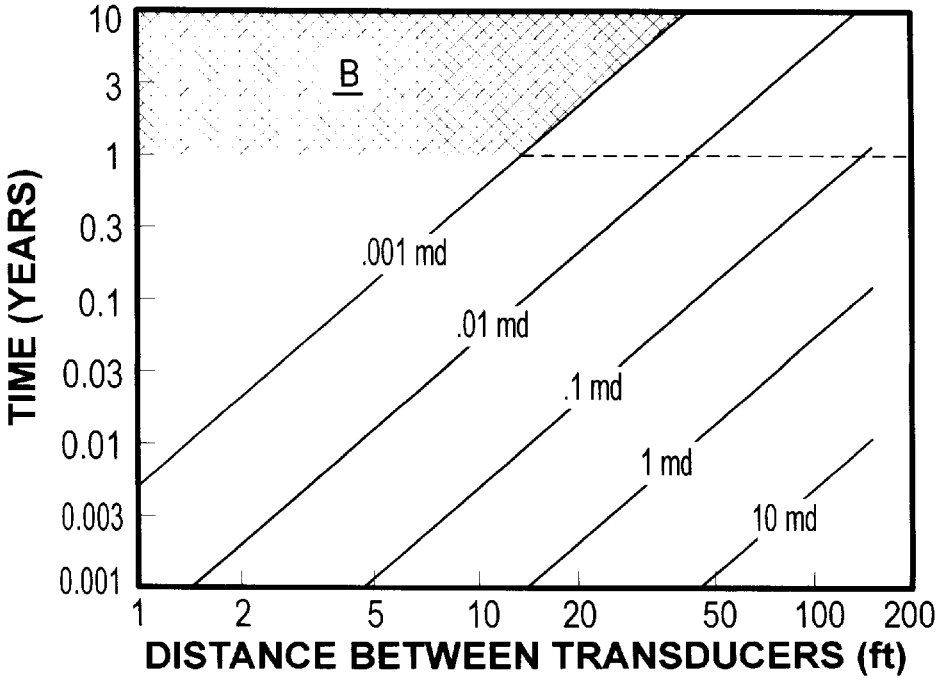
FIG. 11 is a graph illustrating results of modeling pressure response as a function of time, distance and permeability for pressure transmission through the cement between pressure sensors.

The graphs of FIGS. 9–11 illustrate design parameters as conservatively modeled for application to a given well. FIG. 9 illustrates the basic relationship of pressure migration through cement as a function of percent pressure change, time, and cement permeability (assuming that cement selection holds porosity and compressibility substantially constant). Under these constraints, FIG. 10 models a range of cement permeabilities, delay (days), and distance $R_{max}$ based on a design criteria of 98% of the formation pressure being seen at the pressure sensor. The area "A" indicates how close to the formation the transducer must be to respond. FIG. 11 then models a range of cement permeabilities, delay (years), and separation, $D_{min}$, illustrating a suitable range of sensor separation as area B based on a design criteria of no more than 5% of the pressure at a sensor in one zone migrating through the cement and interfering with the pressure measurement in the second zone.

The optimal spacing between sensors (D) (see FIG. 1) is determined after a cement permeability is selected. The selected permeability must allow a rapid sensor response time while minimizing the error in pressure response due to communication through the cement between sensors. In this example, cement permeability greater than 0.001 md allows a response time of less than 10 days through ½ inch of cement ($R_{max}$) and cement permeability less than 0.03 md allows sensors 50 feet apart ($D_{min}$) to remain isolated (to within 5% error) for more than one year. The cement was formulated to be 0.01 md to balance these two criteria.

The importance of the pressure tentacle as a means to control ($R_{max}$) is apparent in designing such a system, e.g., calling for mounting sensors on a 5" casing within an 11½ borehole. The pressure tentacle ensures an effective pressure conduit that is adjacent the formation and not affected by any minor, very localized variations in the cement mixture.

Figure 8:
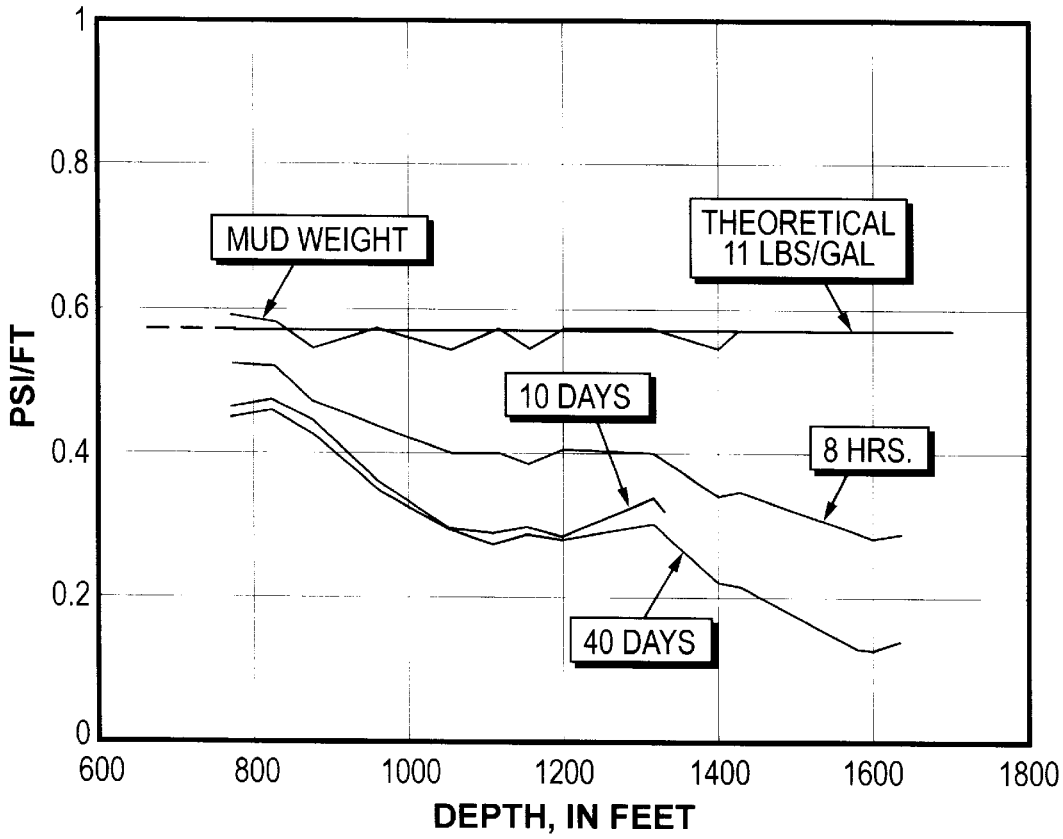
FIG. 8 is a graph illustrating pressure changes in the cement over time.

FIG. 8 illustrates the pressure gradient in a well as a function of pressure, depth, and time as is particularly useful for reservoir management. Here the pressure at selected lower zones is shown to decrease over time. Excessive pressure depletion in any zone may lead to formation compaction which can collapse the well casing and lead to well failure. The sensor array provides notice of pressure depletion and timely access to this data allows adjustments in pumping schedules and/or secondary recovery operations to protect the well and to maximize production efficiency.

Figure 6:
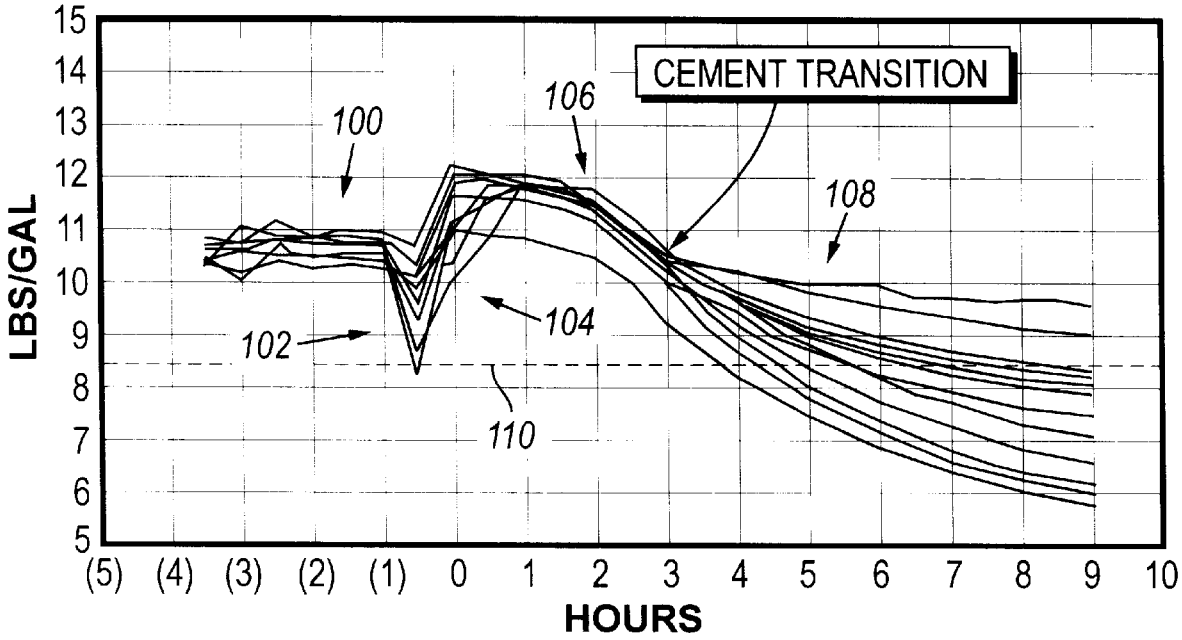
FIG. 6 is a graph illustrating data collected by monitoring multiple zones during successful cementing operations for a well.
Figure 7A:
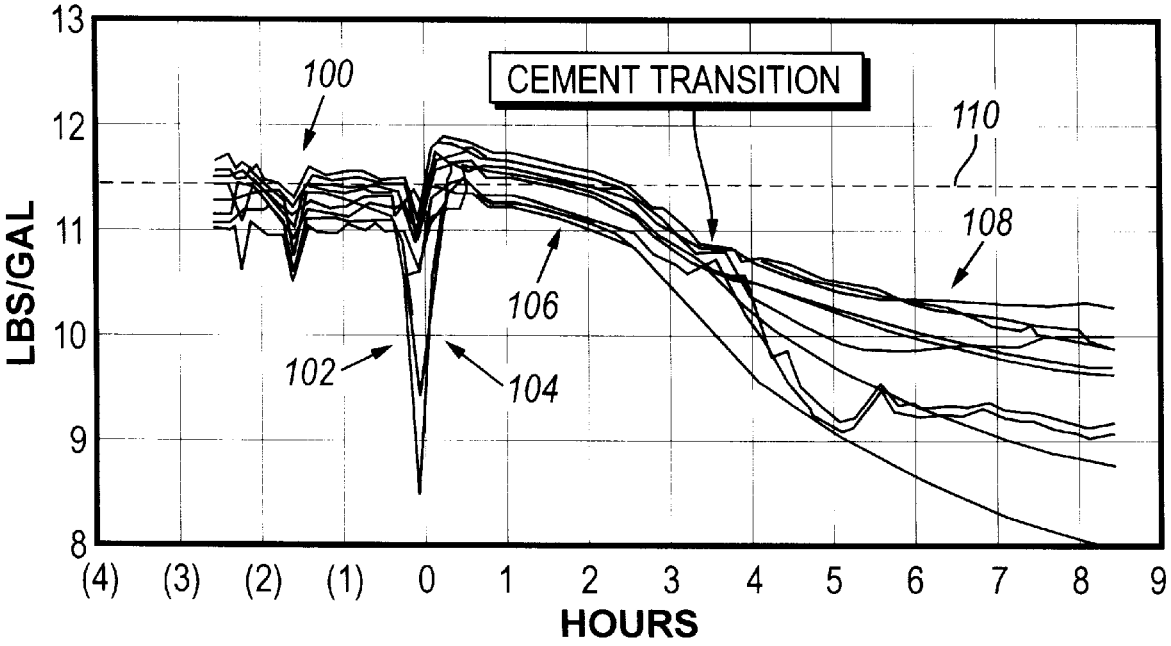
FIG. 7A is a graph illustrating data collected by monitoring multiple zones during cementing operations for a well which was predicted to require remedial actions.

FIGS. 6 and 7A illustrate a special application of distributed pressure monitoring system 10 to monitor cement jobs for secure seals against the casing. The casing is set with the distributed monitoring system in place. The mud stabilizing the formation and controlling the well has a density indicated on the graph at region 100. The mud is displaced with a water/surfactant slug which appears as a sharp drop 102 which is followed by pumping cement down the casing and up the annulus of the borehole which appears as a sharp rise in density at 104. After the column of cement is in place, it begins to set. This process begins with a cement matrix forming due to cement slurry particulates reacting, bridging and mechanically bonding to the formation. The density of the slurry column thus decreases, which translates to a decrease in fluid pressure within the cement matrix. At this juncture, the nature of the cement reaction is such that the pressure trend decreases with a negative curvature 106 When the cement bonds achieve sufficient strength, the cement matrix behaves completely like a solid. Water trapped in the cement matrix at close to hydrostatic pressure diffuses in (or out) of the formation, until it equilibrates with formation pressure. This state of pressure increase (or decrease) must trend with a positive curvature 108. The inflection point between these two regimes is, by definition, the point at the cement can handle the formation load, and is labeled "cement transition" in the FIGS. 6 and 7A. This "cement transition" indicates that the cement is going from fluid behavior to solid behavior.

Returning to FIGS. 6 and 7A–7C, the maximum formation pressure 110 may be historically available, or may be observed after the cement sets fully and formation pressure migrates through the cement to pressure sensors. The critical difference illustrated between FIGS. 6 and 7A is that the cement transition of FIG. 6 occurs before the pressure in the cement column drops below the maximum formation pressure. That is, the cement develops structural integrity before the formation has a chance to flow in toward the cement column, disaggregating the cement matrix, and allowing fluid (gas or liquid) to flow to the surface. Contrast FIG. 6 with FIG. 7A where such failure is predicted. In this instance, expensive remedial action was required in the form of a "squeeze job" in which cement is injected into the pathway of the annular fluid (gas or liquid) flow to stop hydrocarbons from flowing to the surface through the cemented annulus. Having contemporaneous access to this data not only predicts when remedial action will be required, but allows the design of future cementing to better meet the needs of the formation.

Figure 7B:
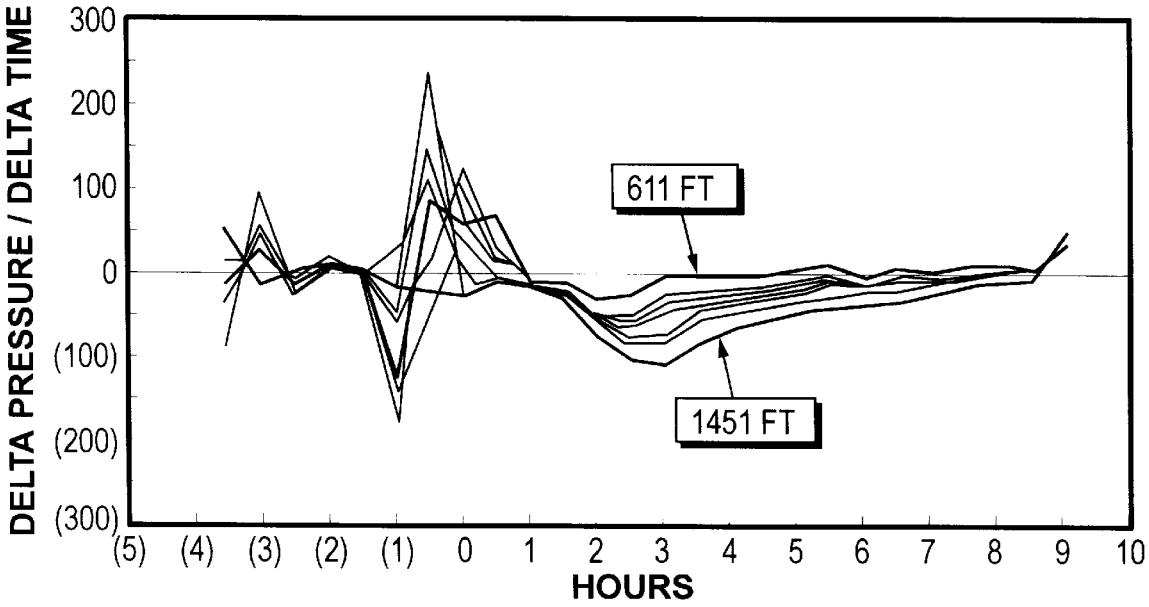
FIG. 7B is a graph illustrating the slope of the pressure time plot against time.

The slope of the pressure time plot versus time is shown in FIG. 7B, which mathematically illustrates the existence of the inflection point. The corresponding transition time is shown in FIG. 7C.

Figure 7C:
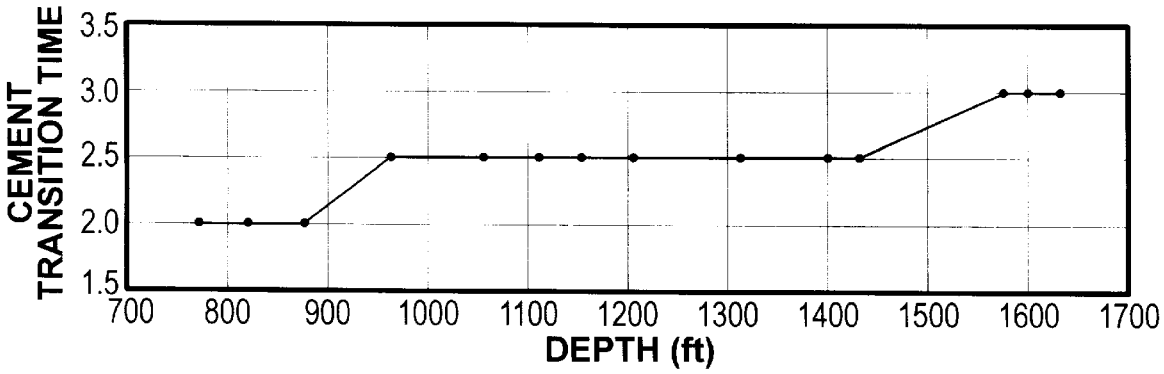
FIG. 7C is a graph illustrating the transition time against depth in the well bore.

FIG. 7C indicates that the transition time occurs later, the deeper the transducer. This appears consistent with the fact that for a given gel strength, the cement column can only support its own weight to a certain depth. Below that depth, the cement continues to behave like a fluid until the cement gains additional gel strength. (Note: "Conventional wisdom" suggests cement sets from the deeper sections of the well up the column to shallower depths. This is true when there is a significant temperature differential throughout the cement column. In wells, there is only a 5 degree temperature difference of over the length of the interval.

The foregoing description is merely illustrative of some embodiments of the present invention and many variations are set forth in the preceding discussion. Further, other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A method for monitoring a cementing operation to predict whether an effective formation-to-casing seal has been formed across an annulus of a well, said method comprising:

determining the maximum formation pressure for a borehole;

installing a distributed well monitoring system in the annulus of the well;

pumping cement into the annulus;

monitoring the pressure in the cement substantially along the length of the annulus;

determining the pressure in the annulus at cement transition; and comparing the pressure at cement transition to the maximum formation pressure as an indication of whether the cement had set to a strength sufficient to maintain an effective formation-to-casing seal across the annulus.

2. A method for monitoring a cementing operation in accordance with claim 1 wherein determining the pressure in the annulus at cement transition comprises:

providing an output of the pressure in the annulus as a function of weight per volume against time across a plurality of sensors spaced along the length of the annulus;

monitoring the rate of change in said output as a positive curvature as solids precipitate from a cement slurry which has been pumped into the annulus;

monitoring the rate of change in said output as a negative curve as the weight of the column of cement in the annulus transfers to the borehole and casing as the cement sets;

identifying the transition of the rate of change in the output from a positive to a negative curvature as the cement transition.

3. A method for monitoring a cementing operation in accordance with claim 2 wherein the determining the maximum formation pressure for the borehole is determined from historical data for the field.

4. A method for monitoring a cementing operation in accordance with claim 3, further comprising determining whether remedial action will be undertaken for the cement job.

5. A method for monitoring a cementing operation in accordance with claim 2 wherein the determining the maximum formation pressure for the borehole is through continued monitoring with the distributed well monitoring system to project an equilibrium pressure as formation pressure migrates into the cement.

6. A method for monitoring a cementing operation in accordance with claim 5 further comprising modifying the cement job on a subsequent well in the field as a result of said comparison.

* * * * *